US009241606B2

(12) United States Patent
Cetinkaya et al.

(10) Patent No.: US 9,241,606 B2
(45) Date of Patent: Jan. 26, 2016

(54) DISHWASHER

(71) Applicant: Arcelik Anonim Sirketi, Istanbul (TR)

(72) Inventors: Ebru Cetinkaya, Istanbul (TR); Ismail Demircioglu, Istanbul (TR); Erdem Akyildiz, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 71 days.

(21) Appl. No.: 14/356,390

(22) PCT Filed: Oct. 23, 2012

(86) PCT No.: PCT/EP2012/070964

§ 371 (c)(1),
(2) Date: May 5, 2014

(87) PCT Pub. No.: WO2013/064394

PCT Pub. Date: May 10, 2013

(65) Prior Publication Data

US 2014/0305475 A1 Oct. 16, 2014

(30) Foreign Application Priority Data

Nov. 4, 2011 (TR) ..... A 2011/11062

(51) Int. Cl.

| | |
|---|---|
| ***A47L 15/50*** | (2006.01) |
| ***A47L 15/42*** | (2006.01) |
| ***A47L 15/00*** | (2006.01) |
| *A47L 15/23* | (2006.01) |

(52) U.S. Cl.
CPC ..... *A47L 15/4278* (2013.01); *A47L 15/0049* (2013.01); *A47L 15/50* (2013.01); *A47L 15/23* (2013.01); *A47L 15/507* (2013.01); *A47L 2401/24* (2013.01)

(58) Field of Classification Search
CPC ..... A47L 15/504
See application file for complete search history.

(56) References Cited

U.S. PATENT DOCUMENTS

| | | | | |
|---|---|---|---|---|
| 5,211,189 | A * | 5/1993 | Santarossa | A47L 15/23 134/179 |
| 2013/0009530 | A1* | 1/2013 | Merz | A47L 15/507 312/228 |

* cited by examiner

*Primary Examiner* — Jason Ko
(74) *Attorney, Agent, or Firm* — Venjuris P.C.

(57) ABSTRACT

The present invention relates to a dishwasher (1) comprising a washing tub (2) having a base (3), a rear wall (4) and two side walls (5) surrounding the base (3), a door (6) providing access to the washing tub (2), connected to the washing tub (2) from its lower side and opening by tilting forward, a rack (8) wherein objects to be washed are placed, having more than one roller (7) disposed at two opposite sides of its lower surface, providing it to move forwards/backwards, having a washing position whereat it is placed on the base (3) to entirely remain inside the washing tub (2), a loading position whereat it is positioned on the inner surface of the door (6) by being moved forwards when the door (6) is open and whereat loading-unloading can be performed and a spray arm (9) extending from the base (3) towards inside the washing tub (2), remaining under the rack (8) when the rack (8) is in the washing position, spraying water towards inside the rack (8) by rotating around itself.

10 Claims, 5 Drawing Sheets

DISHWASHER

Figure 1:
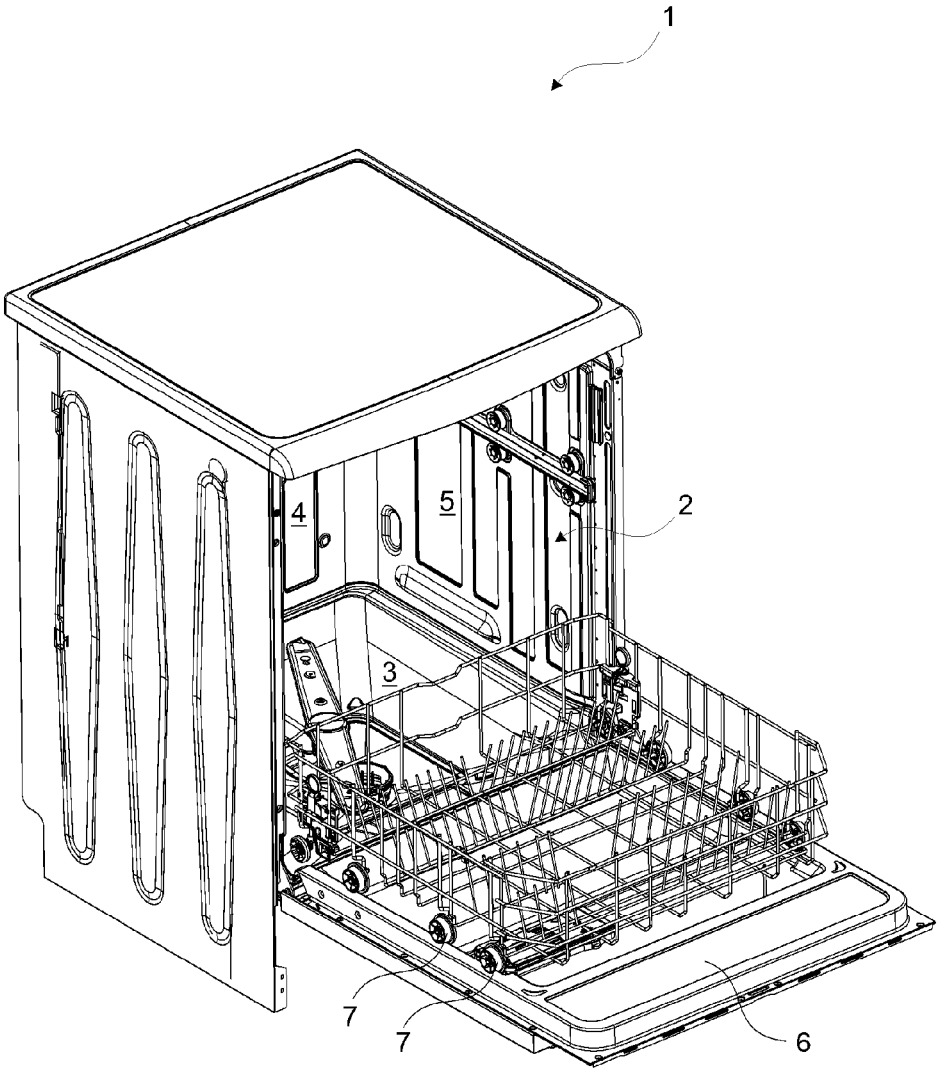

The present invention relates to a dishwasher the washing effectiveness of which is increased.

As is known, dishwashers comprise upper and lower racks, generally disposed in the washing chamber, for placing kitchen utensils therein. Each rack is moved outwards from the washing chamber, providing the loading of the kitchen utensils into the rack or the unloading thereof from the rack.

A spray arm, connected to the water line, is disposed under each rack which sprays water unto the objects placed into the rack by rotating around itself.

The sprays arms should rotate freely without being blocked by any of the dishes in order to effectively clean the dishes placed into the rack. Therefore, the user controls whether or not there is a barrier that gets stuck with the spray arms by manually rotating both of the spray arms after loading objects to be washed into the rack. Due to positioning of the spray arms, it is not a problem to rotate the spray arm disposed under the upper rack but reaching the lower spray arm is problematic. It causes problems for the user to bend for reaching the lower spray arm and to find the spray arm under the lower rack.

In the state of the art German Patent Document No. DE4020898, a dishwasher is described, comprising a sensor which is disposed on the side wall and which registers the rotation of the spray arm. The sensor indicates the spray arm blockage originating due to incorrect loading of objects to be washed and the damages that may occur are prevented in advance.

The aim of the present invention is the realization of a dishwasher, the washing effectiveness of which is increased.

The dishwasher realized in order to attain the aim of the present invention, explicated in the first claim and the respective claims thereof, comprises a rack that can be moved forwards/backwards by means of the rollers disposed on its two opposite sides, having a washing position wherein it is mounted into the washing tub and dishes placed therein are washed and a loading position it is changed to from the washing position by opening the door and by being moved onto the door, wherein loading and loading is performed, a spray arm disposed under the rack, that can rotate around the axis whereto it is attached, spraying water into the rack during washing and a pusher disposed on the rack, that can move the spray arm by contacting the spray arm while the rack is being changed from the loading position to the washing position and providing one end of the spray arm to be directed towards the door. When the pusher contacts the spray arm, the spray arm rotates slowly since it is attached so as to freely rotate around itself and is positioned with one end extending towards the door. Thus, access of the user to the spray arm becomes easy and the user is provided to control whether or not any one object placed into the rack blocks the rotation of the spray arm. The pusher is positioned on the rack such that the rotation of the spray arm is not blocked when the rack is in the washing position. The washing performance of the dishwasher is improved, problems like spray arm blockage during washing etc are prevented by means of the user controlling whether or not there is any barrier impacting the spray arm by rotating the spray arm manually at the start of the washing process.

In an embodiment of the present invention, the pusher extends from the bottom outer surface of the rack towards outside in the vertical direction. When the rack is in the washing position, the pusher extends from the bottom of the rack towards the base of the washing tub. Since the spray arm is disposed under the rack, the pusher provides the spray arm to rotate by impacting and pushing the spray arm and one end to face towards the door while the rack is being changed from the loading position to the washing position.

In another embodiment of the present invention, the portion whereat the pusher is positioned remains outside of the circular area under the rack that is swept by the spray arm while rotating when the rack is in the washing position. Thus, the pusher is prevented from obstructing the rotation of the spray arm while the rack is in the washing position.

In another embodiment of the present invention, the rack comprises a support surface composed of wires in grill form, lateral surfaces disposed on two sides of the support surface and a front surface and a rear surface extending between the two lateral surfaces. The pusher is disposed at the bottom side of the support surface, near the rear surface.

In another embodiment of the present invention, the pusher is fastened to the rack by welding method.

In another embodiment of the present invention, the pusher is produced as integrated with the rack.

By means of the present invention, the access of the user to the spray arm is made easy for performing the rotation process of the spray arm at the start of washing in order to control whether or not any object is impacting the spray arm.

A dishwasher realized in order to attain the aim of the present invention is illustrated in the attached figures, where:

FIG. 1—is the perspective view of a dishwasher when the rack is in the loading position.

Figure 2:
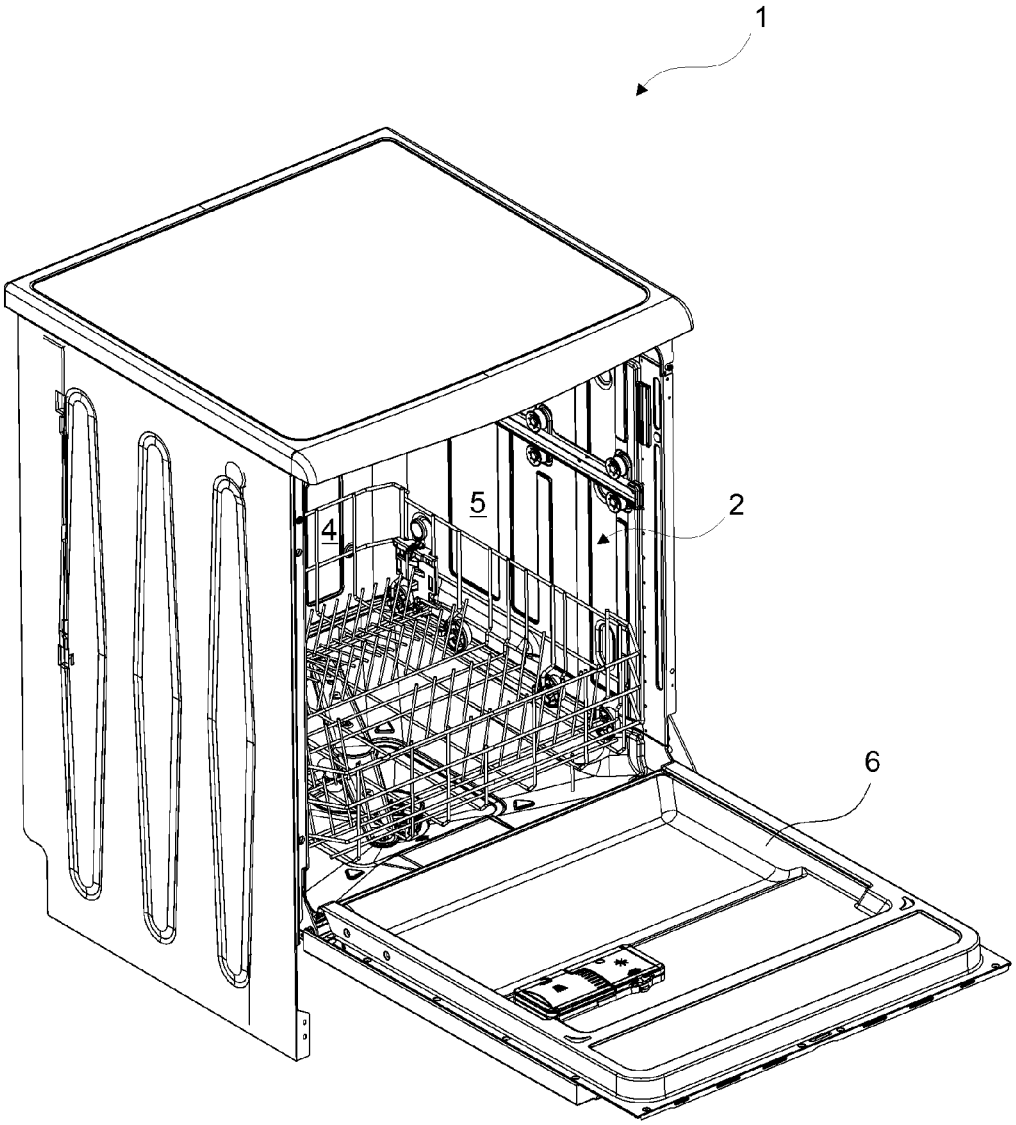

FIG. 2—is the perspective view of a dishwasher when the rack is in the washing position.

Figure 3:
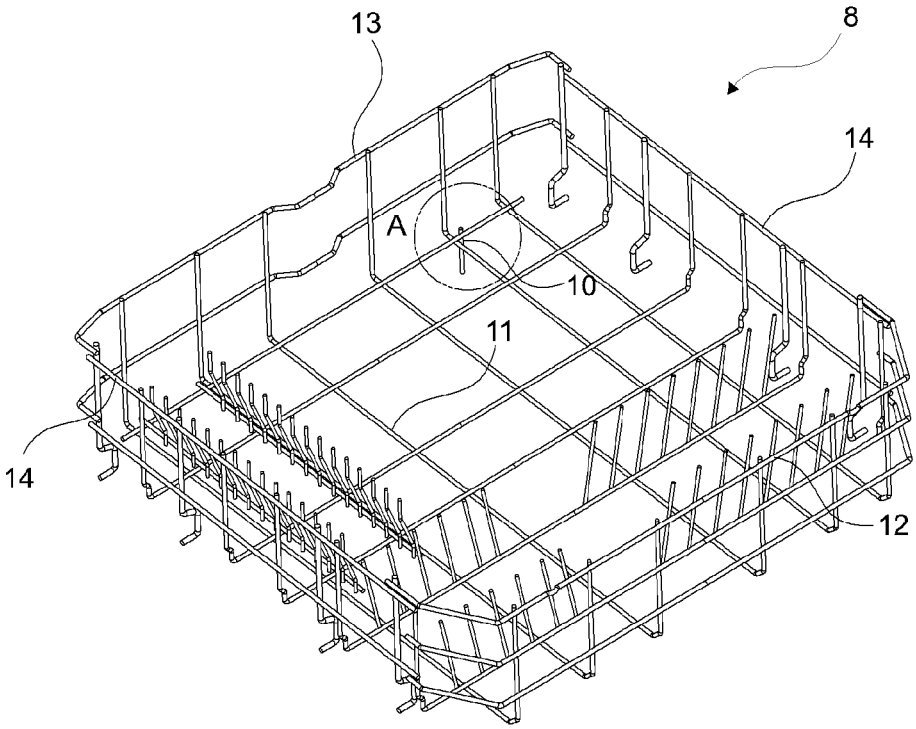

FIG. 3—is the perspective view of a rack.

Figure 4:
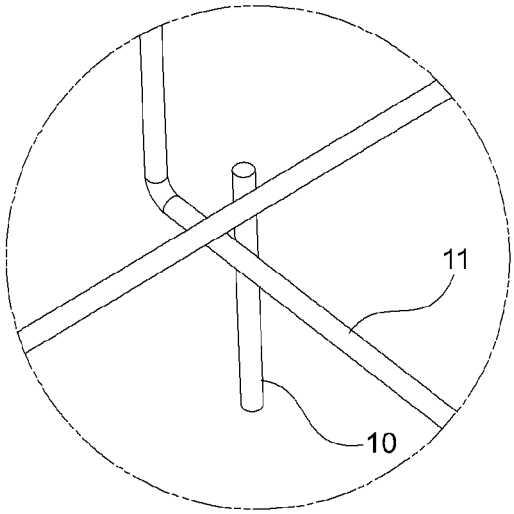

FIG. 4—is the perspective view of detail A in FIG. 3.

Figure 5:
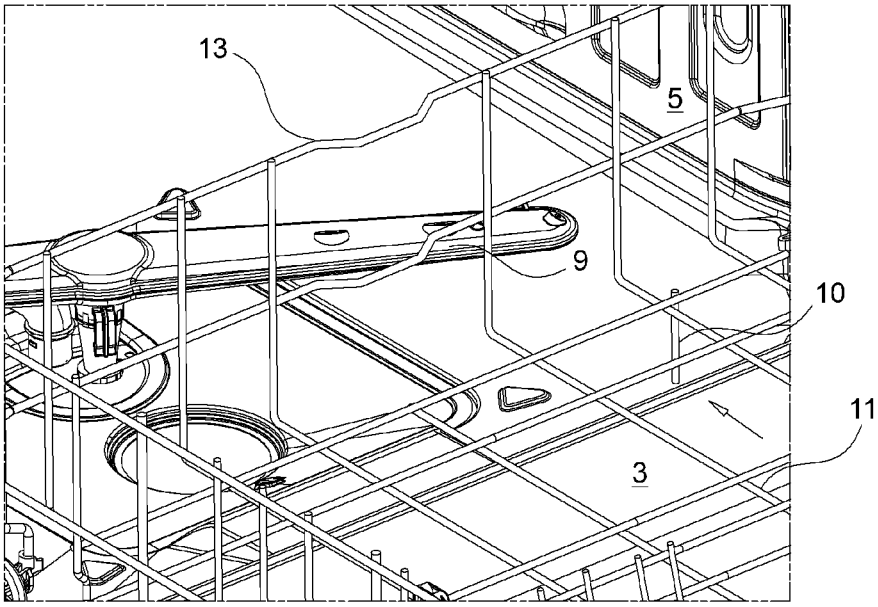

FIG. 5—is the partial perspective view of the spray arm and the pusher while the rack is being changed from the loading position to the washing position.

Figure 6:
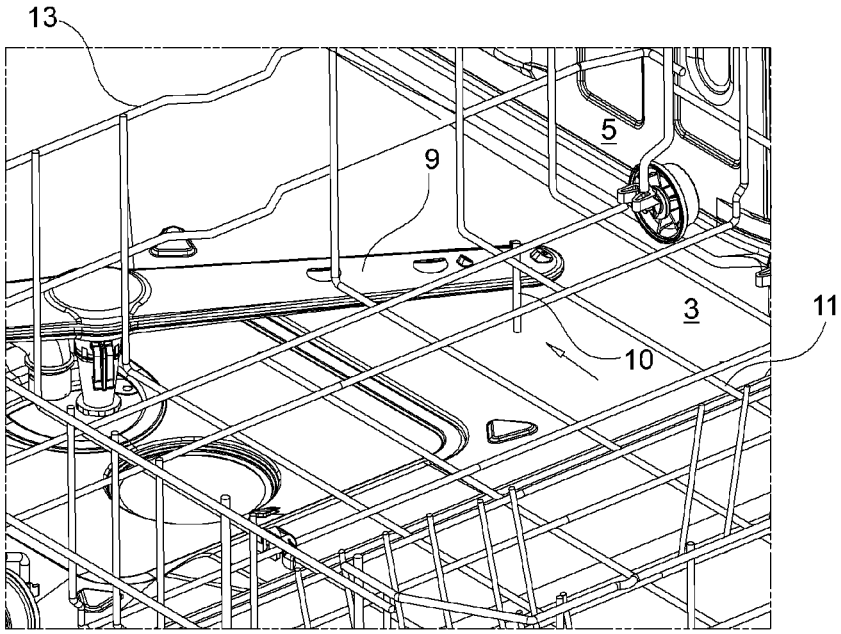

FIG. 6—is the partial perspective view of the spray arm and the pusher at the moment the pusher impacts the spray arm while the rack is being changed from the loading position to the washing position.

Figure 7:
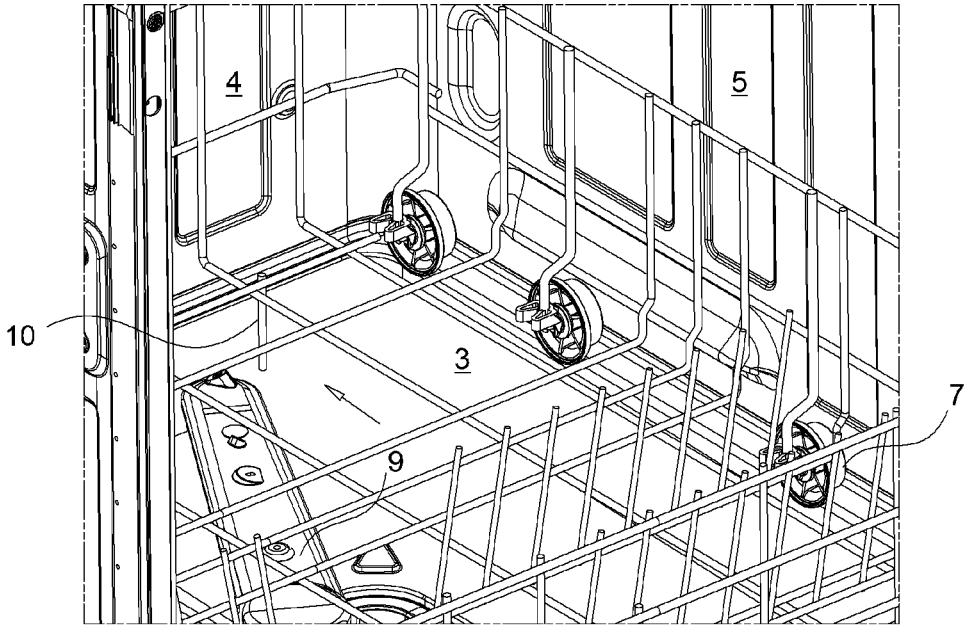

FIG. 7—is the partial perspective view of the spray arm and the pusher after the pusher moves the spray arm while the rack is being changed from the loading position to the washing position.

Figure 8:
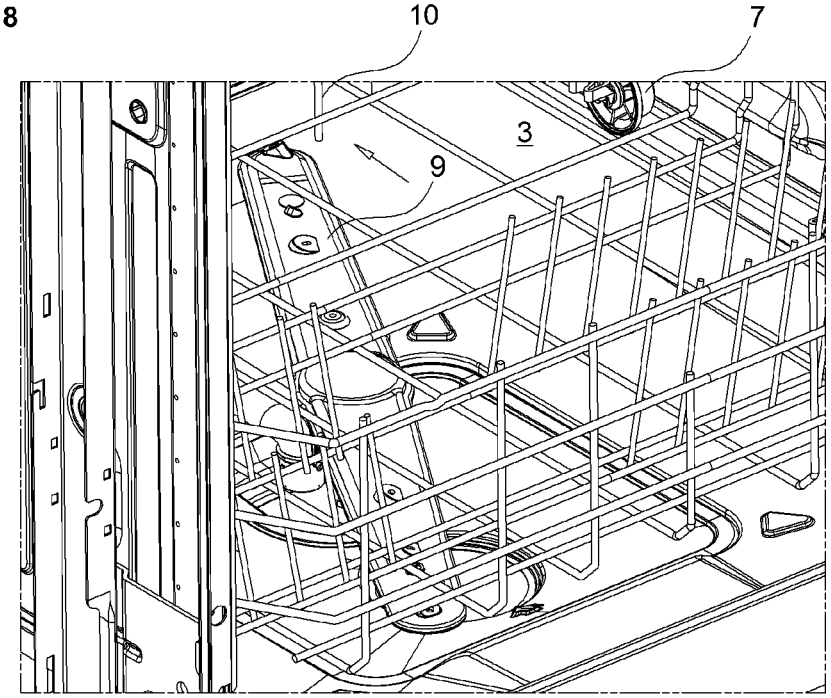

FIG. 8—is the partial perspective view of the spray arm and the pusher when the rack is in the washing position.

The elements illustrated in the figures are numbered as follows:

1. Dishwasher
2. Washing tub
3. Base
4. Rear wall
5. Side wall
6. Door
7. Roller
8. Rack
9. Spray arm
10. Pusher
11. Support surface
12. Front surface
13. Rear surface
14. Lateral surface The dishwasher (1) comprises a washing tub (2) having a base (3), a rear wall (4) and two side walls (5) surrounding the base (3), a door (6) providing access to the washing tub (2), connected to the washing tub (2) from its lower side and opening by tilting forward, a rack (8) wherein objects to be washed are placed, having more than one roller (7) disposed at two opposite sides of its lower surface, providing it to move forwards/backwards, having a washing position whereat it is placed on the base (3) to entirely remain inside the washing tub (2) and a loading position whereat it is positioned on the inner surface of the door (6) by being moved forward when the door (6) is open, whereat loading-unloading can be performed and a spray arm (9) extending from the base (3) towards inside the washing tub (2), remaining under the rack (8) when the rack (8) is in the washing position, spraying water towards inside the rack (8) by rotating around itself.

The dishwasher (1) furthermore comprises a pusher (10) that extends outwards from the bottom surface of the rack (8), that provides one end of the spray arm (9) to be directed towards the door (6) by impacting the spray arm (9) while the rack (8) is being changed from the loading position to the washing position and that does not obstruct the rotation of the spray arm (9) when the rack (8) is changed to the washing position.

The door (6) is opened for loading the dishes to be washed into the rack (8) and the rack (8) is pulled forwards so as to be seated on the inner surface of the door (6). The rack (8) that is changed to the loading position is pushed forwards after loading the dishes to be washed therein and the rack (8) is provided to be placed into the washing tub (2). The pusher (10) provides the end of the spray arm (9) to move forwards by impacting the spray arm (9) while the rack (8) is being changed from the loading position to the washing position. Thus, the user controls whether or not the spray arm (9) rotates freely by rotating the spray arm (9), the end of which faces the door (6). By means of the pusher (10), the access of the user to the spray arm (9) and performing rotation control of the spray arm (9) are made easier. The pusher (10) is positioned on the rack (8) so as not to obstruct the rotation of the spray arm (9) during washing. In other words, the pusher (10) is disposed on an area of the rack (8) that remains outside the rotational diameter of the spray arm (9) when the rack (8) is in the washing position.

By means of controlling the spray arm (9), the problem of any container impacting the spray arm (9) originating from placing the dishes incorrectly into the rack (8) and blocking the rotation of the spray arm (9) is eliminated. At the start of the washing process, the rotation of the spray arm (9) without any problems is maintained and the risks like blockage of the spray arm (9), motor strain due to the spray arm (9) not being able to rotate etc are eliminated. During the rotation control of the spray arm (9), the user, upon detecting that there is a container impacting the spray arm (9), corrects the position of the container in the rack (8) by changing the rack (8) to the loading position. Consequently, the spray arm (9) is provided to rotate freely during the washing process, providing the spray arm (9) to spray water effectively unto the dishes in the rack (8) and the washing effectiveness is guaranteed.

In an embodiment of the present invention, the pusher (10) is formed as an extension, extending from the bottom outer surface of the rack (8) outwards in the vertical direction. When the rack (8) is changed to the washing position, the pusher (10) extends towards the base (3). When the rack (8) is changed to the loading position, the pusher (10) extends towards the inner surface of the door (6). Since the spray arm (9) is disposed under the rack (8), the pusher (10) impacts the spray arm (9) while the rack (8) is being changed from the loading position to the washing position.

In another embodiment of the present invention, the pusher (10) is mounted on the rack (8) so as to remain outside the area swept by the spray arm (9) while rotating when the rack (8) is in the washing position. The rack (8) is preferably quadrangular shaped matching the configuration of the base (3). The spray arm (9) sweeps a circular area during its rotation by rotating around the axis whereto it is attached. Consequently, when the rack (8) is changed to the washing position, the pusher (10) remains outside the area swept by the spray arm (9) during its rotation and does not block the rotation of the spray arm (9).

In another embodiment of the present invention, the rack (8) comprises a support surface (11) composed of wires in grid form, a front surface (12), a rear surface (13) and two lateral surfaces (14) surrounding the support surface (11) and the pusher (10) is disposed at the portion of the support surface (11) that is near the rear surface (13). The support surface (11), the front surface (12), the rear surface (13) and the lateral surfaces (14) are formed by joining the wires arranged parallel to each other. The pusher (10) is disposed at the portion of the support surface (11) near the intersection area of the rear surface (13) and one of the lateral surfaces (14) so as to remain under the support surface (11). Thus, when the rack (8) is in the washing position, the spray arm (9) is prevented from impacting the pusher (10) during its rotation.

In another embodiment of the present invention, the pusher (10) is attached to the rack (8) by welding. The rack (8) and the pusher (10) are produced separately and the pusher (10) is connected to the rack (8) by being welded.

In another embodiment of the present invention, the pusher (10) is produced as integrated with the rack (8).

By means of the present invention, the washing effectiveness is improved by facilitating the access of the user to the spray arm (9) and performing control of rotation.

It is to be understood that the present invention is not limited to the embodiments disclosed above and a person skilled in the art can easily introduce different embodiments. These different embodiments should also be considered within the scope of the claims of the present invention.

The invention claimed is:

1. A dishwasher (1) comprising a washing tub (2) having a base (3), a rear wall (4) and two side walls (5) surrounding the base (3), a door (6) providing access to the washing tub (2), connected to the washing tub (2) from its lower side and opening by tilting forward, a rack (8) wherein objects to be washed are placed, having more than one roller (7) disposed at two opposite sides of its lower surface, providing it to move forwards/backwards, having a washing position whereat it is placed on the base (3) to entirely remain inside the washing tub (2), a loading position whereat it is positioned on the inner surface of the door (6) by being moved forwards when the door (6) is open and whereat loading-unloading can be performed and a spray arm (9) extending from the base (3) towards inside the washing tub (2), remaining under the rack (8) when the rack (8) is in the washing position, spraying water towards inside the rack (8) by rotating around itself, characterized by a pusher (10) that extends outwards from the bottom surface of the rack (8), that provides one end of the spray arm (9) to be directed towards the door (6) by impacting the spray arm (9) while the rack (8) is being changed from the loading position to the washing position and that does not obstruct the rotation of the spray arm (9) when the rack (8) is changed to the washing position.

2. A dishwasher (1) as in claim 1, characterized by the extension shaped pusher (10) that extends from the bottom outer surface of the rack (8) outwards in the vertical direction.

3. A dishwasher (1) as in claim 1 or 2, characterized by the pusher (10) that is mounted on the rack (8) so as to remain outside the area swept by the spray arm (9) while rotating when the rack (8) is in the washing position.

4. A dishwasher (1) as in any one of the above claim 3, characterized by the rack (8) comprising a support surface (11) composed of wires in grid form, a front surface (12), a rear surface (13) and two lateral surfaces (14) surrounding the support surface (11) and the pusher (10) that is disposed at the portion of the support surface (11) near the rear surface (13).

5. A dishwasher (1) as in claim 4, characterized by a pusher (10) that is attached to the rack (8) by welding.

6. A dishwasher (1) as in claim 5, characterized by the pusher (10) that is produced as integrated with the rack (8).

7. A dishwasher (1) as in claim 1, characterized by the pusher (10) that is mounted on the rack (8) so as to remain outside the area swept by the spray arm (9) while rotating when the rack (8) is in the washing position.

8. A dishwasher (1) as in claim 1, characterized by the rack (8) comprising a support surface (11) composed of wires in grid form, a front surface (12), a rear surface (13) and two lateral surfaces (14) surrounding the support surface (11) and the pusher (10) that is disposed at the portion of the support surface (11) near the rear surface (13).

9. A dishwasher (1) as in claim 1, characterized by a pusher (10) that is attached to the rack (8) by welding.

10. A dishwasher (1) as in claim 1, characterized by the pusher (10) that is produced as integrated with the rack (8).

* * * * *